United States Patent [19]

Buchanan

[11] 4,364,510

[45] Dec. 21, 1982

[54] FILLING VALVE FOR A BAG OR OTHER CONTAINER

[75] Inventor: Archibald Buchanan, Ellon, Scotland

[73] Assignee: B.P.B. Industries Limited, London, England

[21] Appl. No.: 170,159

[22] Filed: Jul. 18, 1980

[30] Foreign Application Priority Data

May 2, 1980 [GB] United Kingdom ..... 8014577

[51] Int. Cl.[3] ..... B65D 30/24

[52] U.S. Cl. ..... 229/62.5

[58] Field of Search ..... 229/62.5; 150/9

[56] References Cited

U.S. PATENT DOCUMENTS

| | | | |
|---|---|---|---|
| 1,946,995 | 2/1934 | Weaver | 229/62.5 |
| 3,065,899 | 11/1962 | Means et al. | 229/62.5 |
| 3,191,850 | 6/1965 | Niemeyer | 229/62.5 |
| 3,904,107 | 9/1975 | Nishimura et al. | 229/62.5 |

FOREIGN PATENT DOCUMENTS

| | | | |
|---|---|---|---|
| 1025255 | 2/1958 | Fed. Rep. of Germany | 229/62.5 |
| 852453 | 10/1960 | United Kingdom | 229/62.5 |

*Primary Examiner*—Stephen P. Garbe

*Attorney, Agent, or Firm*—LeBlanc, Nolan, Shur & Nies

[57] ABSTRACT

A leak-proof filling valve for a paper sack is formed by folding a composite sheet formed from Kraft paper 1 on top of which is laid relatively flexible polythene 2. The folded sheet is secured between end flaps 10A, 12 of a paper sack. The sack is charged with material 16 through a mouth 15 and passes through a short inner channel between parts 1C, 1D, and a longer outer channel between parts 2A, 2B. Reverse flow between parts 2A, 2B is prevented by material which percolates into pocket 17, assisted by the different flexibilities of the parts 1A, 2A. Any material which nevertheless does pass into space 18 is prevented from escaping between parts 1C, 1D by accumulation of material in pocket 19 this being assisted by the different flexibilities of parts 1C, 2C.

10 Claims, 3 Drawing Figures

FILLING VALVE FOR A BAG OR OTHER CONTAINER

BACKGROUND OF THE INVENTION

This invention relates to a bag or other container having a valve which allows powdered or other particulate material to be fed into, but does not allow it to escape from, the bag.

Such valves have been formed, in the past, by a sleeve of paper, one end of which extends into the bag. When the bag is full, the pressure of the contents holds the sleeve closed. An example of such a bag is described in U.K. patent specification No. 1,245,720. These known valves unfortunately do not give a perfect seal, particularly against fine powders. The resulting loss of material is expensive and inconvenient and can present a health hazard to those who frequently handle the bags.

The problem of leakage can partially be overcome by cutting a series of slits at the inner end of the sleeve thereby forming a fringe. The strands of paper forming the fringe tend to be carried back through the sleeve with any reverse flow of the powder. The strands then form a blockage, preventing further reverse flow. While this technique does reduce leakage it presents another problem because the strands sometimes tear off and become mixed with the powder. This risk of pollution of the powder with strands of paper is unacceptable for many industrial processes.

SUMMARY OF THE INVENTION

This invention provides a container for particulate material comprising a valve which allows the material to be introduced into the container but resists leakage from the container, the valve comprising a channel having inner and outer layers of different material, one of which is more flexible than the other, the layers defining between them a pocket in which some of the said material may accumulate, thereby restricting the channel.

It is believed that, because of their different flexibilities, there is a tendency for the adjacent layers of different material to assume slightly separated positions, allowing access of the particulate material into the aforementioned pocket. Similarly there is a tendency for adjacent layers of the same material to lie close together thereby reducing the chance of leakage.

DETAILED DESCRIPTION

Figure 1:
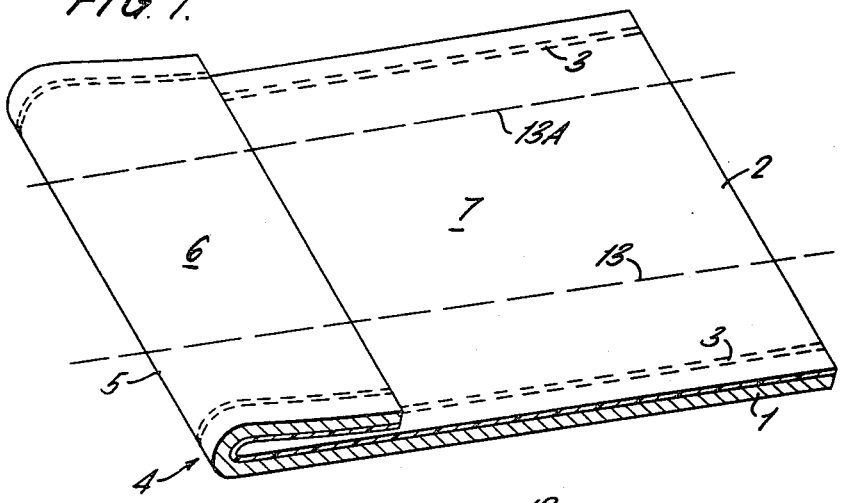
FIG. 1 shows material used in producing a valve for a paper sack constructed in accordance with the invention.

Referring firstly to FIG. 1 there is shown a rectangular sheet 1 of kraft paper over which is placed a substantially thinner sheet 2 of polythene. The thickness of the two sheets is grossly exaggerated in the drawings. The two sheets 1 and 2 are secured together by two lines 3 of adhesive and the resulting composite sheet 4 is folded along a fold line 5 to form an upper part 6 of the composite sheet, which is shorter than the lower part 7. This folded composite sheet is all that is required in order to adapt an otherwise conventional paper sack to employ the present invention.

Figure 2:
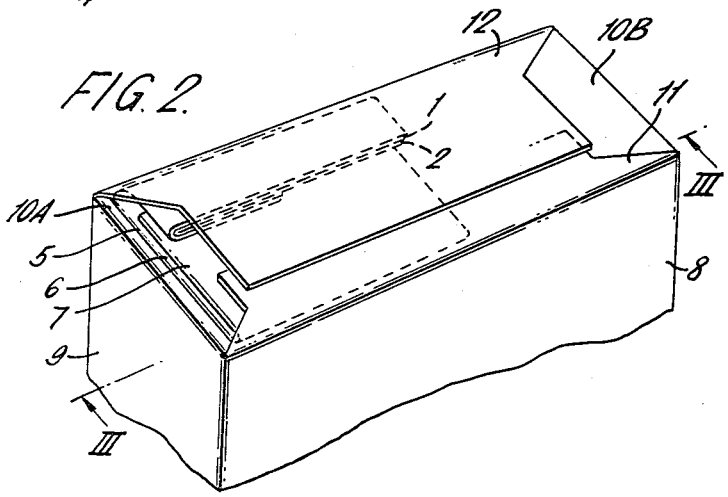
FIG. 2 shows the upper part of the paper sack, fitted with the valve.

The paper sack is shown in FIG. 2 in the condition it adopts after filling. It comprises side walls 8 and 9, two identical end flaps 10A and 10B and two further end flaps 11 and 12. During manufacture of the sack, before the flaps 11 and 12 are folded into the illustrated positions, the composite sheet of FIG. 1 is glued to the flaps 10A, 11 and 12. The flap 11 is then folded over to the illustrated position, this process also serving to fold the already folded composite sheet 4 about the imaginary line 13 shown in FIG. 1. The flap 12 is then folded to the illustrated position thereby also folding the composite sheet 4 about the line 13A of FIG. 1. Finally the top of the sack is sealed by a sheet of kraft paper which is secured by adhesive over all the exposed upper surfaces shown in FIG. 2. This strip of kraft paper is not shown on FIG. 2 since it would hide details of construction. It is however shown at 14 on FIG. 3.

The folding of the composite sheet 4 about lines 13 and 13A forms the lower part 7 into an outer channel and forms the upper part 6 into a shorter inner channel. The inner and outer channels or passageways have a common mouth 15 defined by the edge 5 as shown in FIG. 3.

Figure 3:
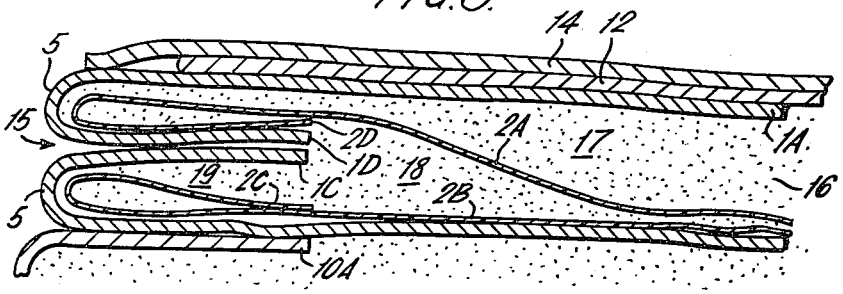
FIG. 3 is a vertical cross-section through the line III—III of FIG. 2.

Referring to FIG. 3 it will be seen that the outer channel has exterior wall parts 1A, 1B of kraft paper and an interior lining formed by parts 2A, 2B of polythene. The polythene parts 2A, 2B are more flexible than the parts 1A, 1B and so they tend to conform to each other's contour. For example the part 2A may sag into the position shown in FIG. 3. This allows powder 16 contained by the sack to enter a pocket 17 between the polythene 2A and the paper part 1A. The pressure of the powder in this pocket 17 helps to restrict even further any space which may be available for the escape of material between the polythene parts 2A and 2B. The outer channel or passageway constituted by parts 1A, 1B, 2A, 2B thus forms a valve which allows the powder to be forced into the sack through the mouth 15 but which does not allow the powder readily to escape.

Should any powder succeed in passing between the polythene parts 2A and 2B of the outer channel it will be prevented from escaping through the mouth 15 by a further valve formed by the inner channel.

Any such powder, e.g. as shown at 18, is likely to fill pockets, such as shown at 19, between the polythene part 2C and the paper part 1C. The pressure of powder in this pocket tends to force part 1C against part 1D thereby restricting the inner channel against the escape of material.

It will be appreciated that many modifications to the illustrated embodiment can be made without departing from the scope of the invention. For example the polythene could be arranged on the reverse side of the paper sheet. The illustrated construction has however proved especially satisfactory in providing an exceptionally reliable seal without the problems of contamination previously referred to.

I claim:

1. A container for particulate material comprising a body portion for containing the particulate material and two flexible superposed sheets of different materials fixed to the body portion, one sheet being more flexible than the other; the superposed sheets being folded to form a tubular structure which defines an access channel for the introduction of the particulate material into the body portion; the respective sheets defining between them, at an inner end of the tubular structure, a first pocket in which the particulate material from the body portion may accumulate, thereby constricting an inner end of the channel and preventing reverse flow of the particulate material from the body portion to the inside of the channel; and an outer end of the tubular structure being inwardly turned so that the respective sheets define between them a second pocket in which particulate material from within the channel may accumulate, thereby constricting an outer end of the channel and preventing reverse flow of the particulate material from the channel to outside the container.

2. A container according to claim 1 wherein the two sheets have contiguous edges at the inner end of the tubular structure, defining between them access to the first pocket.

3. A container according to claim 1 or 2 wherein the two sheets have contiguous edges at the inwardly turned outer end of the tubular structure, defining between them access to the second pocket.

4. A container according to claim 1 wherein the sheets are joined together along a line parallel to the direction of the channel.

5. A container for particulate material including a valve which allows the material to be introduced into the container but which resists leakage from the container, the valve comprising: a first channel extending into the container and having inner and outer layers of different material, one of which is more flexible than the other; a first pocket defined between the layers, in which pocket material may accumulate thereby restricting the first channel; a second channel within the first channel and shorter than the first channel; and a second pocket defined between the channels in which the material may also accumulate thereby restricting the second channel.

6. A container according to claim 5 in which the inner layer of the first channel is of synthetic plastics material and the outer layer of the first channel is paper.

7. A container according to claim 5 or 6 in which the valve is formed from two superposed sheets folded to form a double walled channel.

8. A container according to claim 5 in which the superposed sheets are folded to form inwardly turned portions which define the second channel.

9. A container according to claim 7 in which the sheets are joined together along a line parallel to the direction of the channel.

10. A container according to claim 5 in which the inner layer of the first channel is of a material which is more flexible than the material of the outer layer of the first channel.

* * * * *